United States Patent [19]

Beveridge

[11] 4,316,062

[45] Feb. 16, 1982

[54] ELECTROSTATIC ELECTROACOUSTIC TRANSDUCER

[76] Inventor: Harold N. Beveridge, 505 E. Montecito St., Santa Barbara, Calif. 93103

[21] Appl. No.: 108,065

[22] Filed: Dec. 28, 1979

[51] Int. Cl.[3] ..... H04R 19/00; H04R 31/00

[52] U.S. Cl. ..... 179/111 R; 29/594

[58] Field of Search ..... 179/111 R, 111 E, 115.5 PV; 29/594

[56] References Cited

U.S. PATENT DOCUMENTS

| | | | |
|---|---|---|---|
| 2,493,819 | 1/1950 | Harry | 179/111 R |
| 2,567,889 | 9/1951 | Moreland | 179/111 R |
| 4,063,050 | 12/1977 | Carlson et al. | 179/111 E |
| 4,205,205 | 5/1980 | Babb | 29/594 |

*Primary Examiner*—George G. Stellar

*Attorney, Agent, or Firm*—Griffin, Branigan & Butler

[57] ABSTRACT

An electrostatic transducer includes a thin flexible diaphram portion, two electrode portions and a frame portion. The electrode portions and the diaphram portions are constructed in accordance with U.S. Pat. No. 3,668,335. The frame portion is comprised of two single-piece frame halves each having an "L" shaped cross section with vertical and horizontal legs. The vertical legs include channels cut into their longer dimensions. Each frame-half piece is bent into a rectangular shape to surround one of the electrodes which is retained within the frame-half by a bead of epoxy which extends into the channels on the frame-half to make a relatively rigid frame-half and electrode assembly. Two such assemblies are then affixed to each other with the diaphram tightly stretched in between.

22 Claims, 13 Drawing Figures

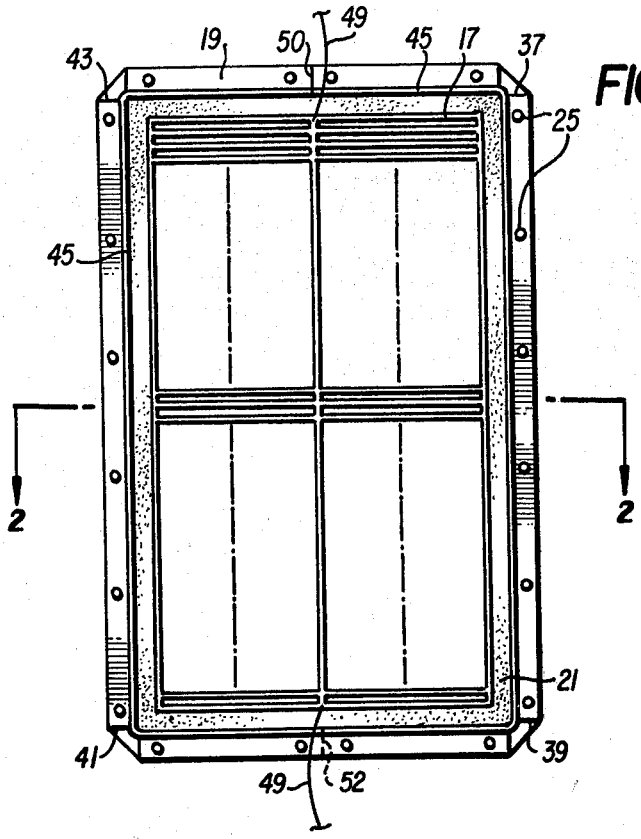
FIG. 1
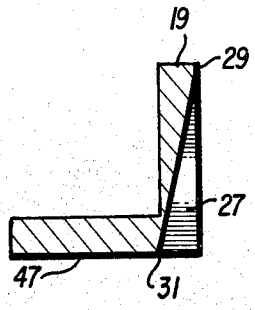
FIG. 5
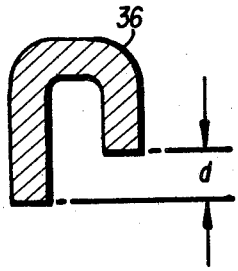
FIG. 7
FIG. 2
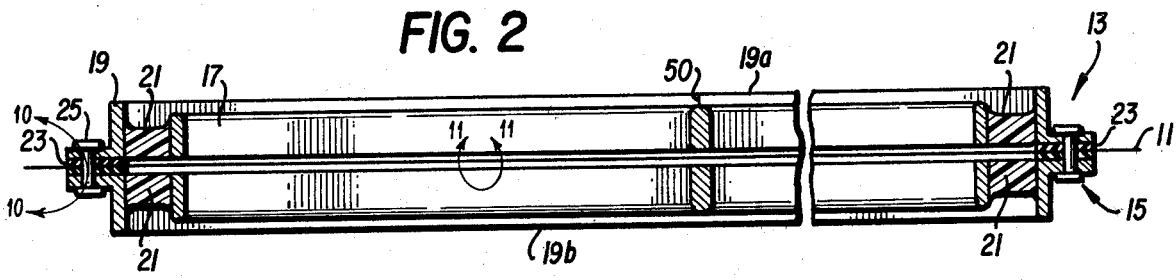
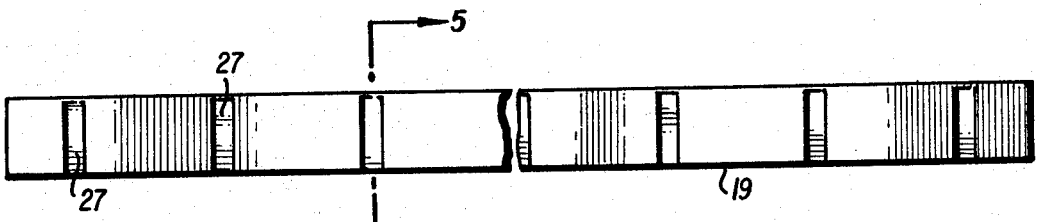
FIG. 4
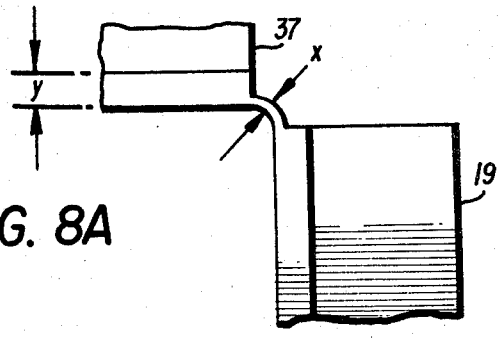
FIG. 8A

ELECTROSTATIC ELECTROACOUSTIC TRANSDUCER

BACKGROUND

This invention relates to an electrostatic transducer and a method of making same.

Electrostatic transducers of the general type about to be described have been subject to serious defects because of changes in expansion between various components. That is, portions of the transducers have tended to warp; and, others have experienced seal separations when subject to temperature changes. It is an object of this invention, therefore, to provide an electrostatic transducer which does not tend to have these deficiences.

Prior transducers have been fabricated with plastic or epoxy rims because electrodes thereof have tended to separate from metallic rims where such structures have been attempted. Such transducers, however, are made in two halves with a thin flexible membrane stretched therebetween; and, it has been difficult to properly fasten the two transducer halves together when their rims have been made of plastic. Accordingly, it is an object of this invention to provide a transducer which permits the use of metal frames which can be more satisfactorily fastened together to maintain tension on the central membrane.

An advantage of the structure about to be described is that it employs frame-halves which are essentially unitary structures which reduce fabrication time and improve accuracy over frame-halves having a plurality of individual parts.

Yet another advantage of the described structure is that the central membrane can be centrally supported so as to result in a reduction of the transducer's power requirements.

SUMMARY

An electrostatic transducer includes a thin flexible diaphram portion, two electrode portions and a frame portion. The electrode portions and the diaphram portions are constructed in accordance with my U.S. Pat. No. 3,668,335. The frame portion is comprised of two single-piece frame halves each having an "L" shaped cross section with vertical and horizontal legs. The vertical legs include channels cut into their longer dimensions. Each frame-half piece is bent into a rectangular shape to surround one of the electrodes which are retained within the frame-half by a bead of epoxy which extends into the channels on the frame-half to make a relatively rigid frame-half and electrode assembly. Two such assemblies are then affixed to each other with the diaphram tightly stretched in between.

BRIEF DESCRIPTION OF THE DRAWINGS

The foregoing and other objects, features, and advantages of the invention will be apparent from the following more particular description of preferred embodiments of the invention as illustrated in the accompanying drawings in which reference characters refer to the same parts throughout the various views. The drawings are not necessarily to scale, emphasis instead being placed upon illustrating principles of the invention in a clear manner.

FIG. 1 is a front elevational view of an electrostatic transducer constructed in accordance with an embodiment of the invention;

FIG. 2 is sectional view of the FIG. 1 transducer taken along the lines 2—2 thereof;

FIG. 4 is a top plan view of the FIG. 3 structure;

FIG. 5 is a sectional view of the FIG. 4 structure taken along the lines 5—5 thereof;

FIG. 7 is a cross-sectional view of another fabrication jig used for lubricant placement during construction of the FIG. 1 transducer;

FIG. 8*a* is an enlarged fragmentary view of the FIG. 8 illustration taken along the arc a—a thereof;

FIGS. 1 and 2 illustrate a transducer of the invention. Therein, the flexible membrane is comprised of aluminized surfaces 11*a* and 11*b* (FIG. 10) on a plastic film such as Mylar 11 which is held taut between two half-frame assemblies 13 and 15. Each half-frame assembly is comprised of an electrode member 17 which is preferably made of a plastic that is cast prior to assembly of the transducer. In this respect, electrodes of the preferred type are described in my U.S. Pat. No. 3,668,335 which issued on June 6, 1972 and is incorporated herein by reference. Each electrode is affixed to a surrounding single-piece frame-half 19 by means of an epoxy fillet 21 extending between each electrode 17 and each frame-half 19.

As shown in FIG. 2 the flexible membrane 11 is held taut between two of the frame-half assemblies 19 by two rectangular gasket members 23 comprised of a material such as neoprene, for example. The two electrode and frame-half assemblies are affixed to each other by means of self-tapping screws, rivets, or the like 25 in suitable holes extending around the frames and through the gaskets and aluminized Mylar as illustrated in FIG. 2.

Figure 3:
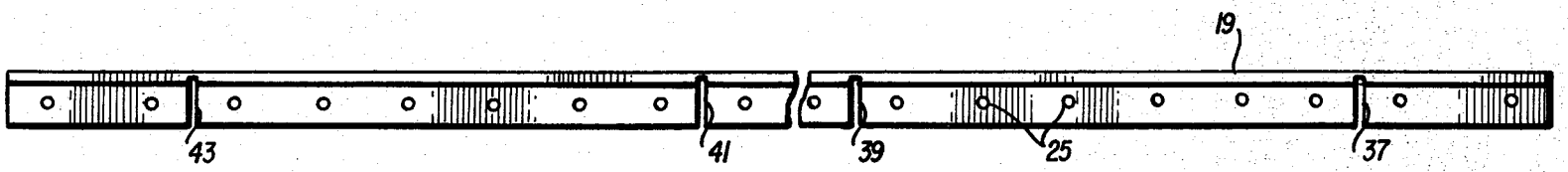
FIG. 3 is a plan view of a frame-half element prior to its being bent into its frame configuration.

The frame-half members 19 are each comprised of a single piece as shown in FIGS. 3 and 4. In this respect, each piece 19 has a right angle cross-section as illustrated in FIG. 5 with a series of channels 27 routed along the inner face thereof at an increasing depth from the upper inner corner 29 of the member 19 to the lower portion 31 thereof as illustrated in FIG. 5. It is not necessary, however, that the channels extend all the way to the top. These routed channels 27 provide a gripping function for the epoxy bead 21 as will be described shortly. One advantage of the canted channels 27 is that they permit the half-frames 19 to have full strength at the upper portions 29 and, at the same time, provide gripping areas for the epoxy bead 21. Additionally, freshly-cut channels provide chemically clean surfaces which are better gripped by the bead 21. In this respect, because of their recessed nature, the slots 27 are not susceptible to picking up greases from the fingers of assemblers and, therefore, tend to maintain their chemically clean surfaces even after they are handled.

Figure 6:
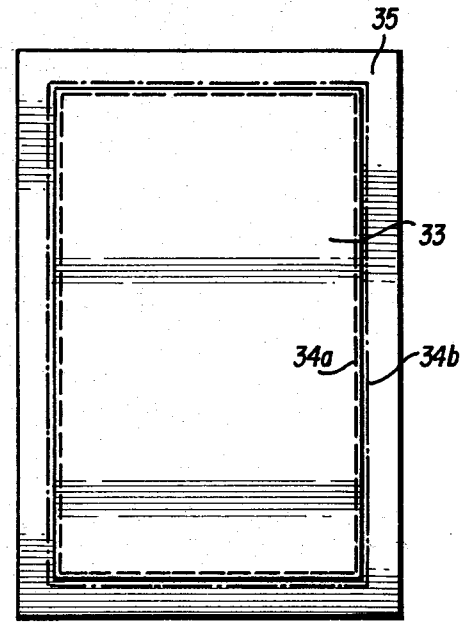
FIG. 6 is a schematic illustration of a construction jig used during fabrication of the FIG. 1 transducer.

The electrode and half-frame assemblies are constructed by affixing a thin forming plate or positioning sheet of material such as aluminum 33 (FIG. 6) to a sheet 35 such as glass having a polished surface. The thin positioning sheet has a thickness, for example, of 0.025 inch and its outer dimensions are the same as the rectangle formed inside the frame member 19 in FIG. 1. In one embodiment, for example, the sheet 33 is about $12\frac{1}{2}\times22\frac{1}{2}$ inches and the frame member is about 70 inches in overall length.

Returning now to FIG. 6, after the positioning sheet 33 is placed on the polished surface 35, two concentric rectangular beads of lubricant such as silicon oil 34*a* and 34*b* are placed on the positioning sheet 33 and the surface 35 about $\frac{1}{4}$ inch or so from the edges of the positioning sheet 33 in a preferred embodiment. A channel-shaped member 36 having a cross-section as illustrated in FIG. 7 can be used to apply the two beads of lubricant. In this respect, the dimension d on FIG. 7 is equal to the thickness of the filler sheet 33—0.025 inch in the illustrated embodiment.

Figure 9:
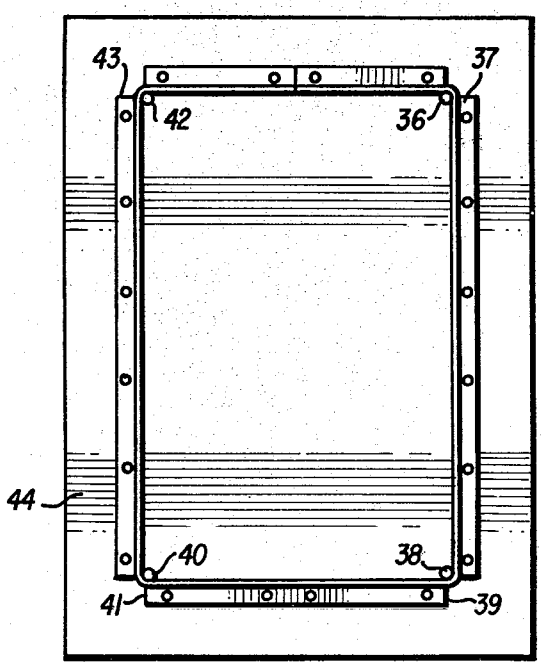
FIG. 9 is a schematic illustration of another fabrication step of the FIG. 1 transducer.
Figure 8:
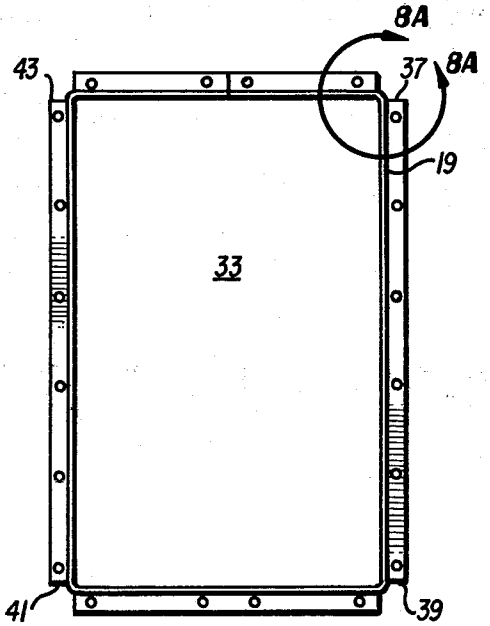
FIG. 8 is a schematic illustration of a fabrication step during construction of the FIG. 1 transducer.

After the lubricant beads 34 are applied, a frame member 19, which has been cut part-way through at points 37, 39, 41, and 43 (FIG. 8A) is placed around the filler sheet 33 and affixed to the polished sheet 35 by suitable clamping or clipping means (not shown). The members 19 are first bent, however, into their rectangular shapes over accurately located dowell pins 36, 38, 40, and 42 on a jig board 44 is shown in FIG. 9. In this manner, the corners, such as 37 in FIG. 8*a*, are smoothly and accurately bent without distortion of the half-frames 19. In this regard, in one preferred embodiment the upright members of the half-frames 19 had a thickness "y" of 0.125 inch, but they were cut through as at corner 37 in FIG. 8*a* so that the thickness "x" of the upright members was only 0.040 inch. The ratio R of "y" to "x", therefore, was about 3 and gave excellent results.

The electrode 17 is next centered on the filler sheet 33 within the frame 19 as illustrated in FIG. 1 so as to leave a uniform gap 45 between the edges of the electrode 17 and the inner edge of the frame member 19. In this regard, the electrode 17 is held in place by a suitable clamping means (not shown) with a cover member such as a sponge or foam sheet being placed over the electrode 17 to produce a uniform pressure to the surfaces of the electrode by a clamping means.

A suitable epoxy is then applied to the gap 45 all the way around the electrode with care being taken to insure that the epoxy fills all of the milled slots or channels 27 on the inner face of the frame 19.

A suitable resin is 2038 manufactured by the Hysol Corporation and a suitable hardener is 3520 manufactured by Hysol Corporation. A suitable preparation has been found to be 1 part hardener to 4 parts resin. Other ratios and types of epoxy can also be used, however.

After application, the epoxy is permitted to cure at room temperature for its proper cure time such as five (5) hours or so. In this manner, there are few if any temperature stresses and the epoxy is cured at the temperature at which it will probably spend most of the remainder of its life. Hence, there are essentially no stresses between the frame, the epoxy, and the electrode; and, the thusly structured assembly is thereby free of one of its greatest tendencies toward warpage. Additionally, the use of single piece frame-halves 19 removes the prior requirement that dowel pins be used to align individual frame pieces during casting of the electrode into the frame pieces. Also, by using the single frame-half members, there is a considerable reduction in the tendency for the epoxy to separate from the frame corners if the assembly is cooled down to sub-freezing temperatures as often occurs during shipment of assembled transducers.

Figure 10:
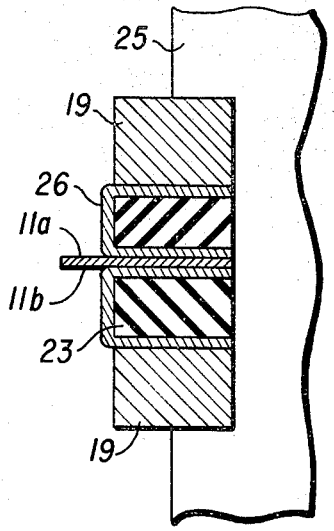
FIG. 10 is a greatly enlarged fragmentary sectional view of a portion of FIG. 2 taken along the arc 10—10 thereof and including shim stock members acting as electrical leads.

After the epoxy has cured, the frame-half and electrode are removed from the glass-positioning sheet assembly 33 and 35. The underface 47 (FIG. 5) of the frame-half is then milled to further assure its flatness. One of the frame-half assemblies 19*a* is then inverted and a first neoprene gasket 23 placed over the milled underside 47 of the frame member. The flexible membrane 11 is then stretched over the first gasket 23 and a second such gasket 23 is glued to a second electrode and half-frame assembly 19*b*. The assembly is then placed on top of the flexible membrane 11 and the entire assembly fastened together with fasteners 25 as illustrated in FIG. 2. Electrical leads such as shim stock, 26 (FIG. 10), are affixed around the neoprene gaskets prior to assembly for electrical connection between the diaphram and frame; and, leads 49 are affixed to the electrodes 17 as shown in FIG. 1.

The two frame-halves 19*a* and 19*b* have their ends 50 and 52 at opposite ends of the assembled transducer as shown in FIG. 1. In this manner, the assembled frame-halves make the transducers about as rigid as if the frame-halves were cast in their rectangular configurations rather than being comprised of strips that are bent into their rectangular shapes as described above.

In the above regard, in a preferred embodiment the gaskets 23 were 0.045 inch thick. Hence, where a filler-sheet thickness of 0.025 inch was employed the taut membrane is held at a distance of 0.070 inch from the inner faces of the two electrodes 17.

Figure 11:
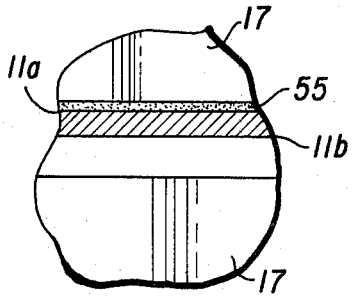
FIG. 11 is a greatly enlarged fragmentary sectional view of a portion of FIG. 2 taken along the arc 11—11 thereof; and, FIG. 12 is an alternative embodiment of the structure illustrated in FIG. 10.

In other embodiments, however, this air gap has been reduced to a total of only about 0.035 inch and, moreover, the aluminized Mylar sheet is affixed at its center by glue 55 (FIG. 11) an adjacent face of an electrode 17 which results in reduced power requirements for the transducer. When the air gap is reduced and the metalized membrane is supported at its center along its entire length (such as in alignment with electrode leads 49 in FIG. 1) the thickness of the membrane can be reduced to about one half the thickness that otherwise might be employed (e.g. one quarter to one half mil as opposed to one half to one mil thickness).

Figure 12:
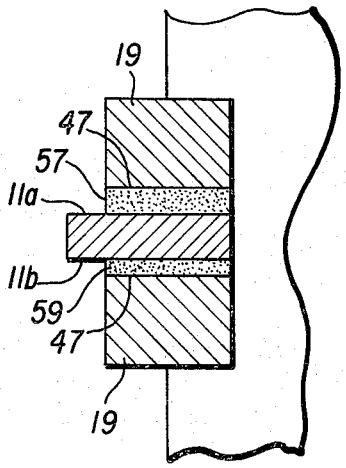

In the above regard, one way of reducing the total air-gap thickness has been to glue the stretched membrane 11 directly to the under sides 47 of the half-frames 19 by layers of glue 57 and 59 (FIG. 12) with the elimination of the gasket members 23. In this manner, the total air-gap was reduced to 0.025 inch on each side of the membrane 11.

While the invention has been particularly shown and described with reference to preferred embodiments thereof, it will be understood by those skilled in the art that various changes in form and detail may be made therein without departing from the spirit and scope of the invention. Different types of epoxies can be used, for example, and the stated dimensions can be modified to suit different applications.

The embodiments of the invention in which an exclusive property or privilege are claimed are defined as follows:

1. An electrostatic electroacoustic transducer including electrode portions and frame portions, at least one of said frame portions comprising:
   a length of metal having at least one face thereon and having a plurality of channels cut into said face;
   said length of metal being bent to surround one of said electrode portions; and,
   said channels being adjacent said one electrode portion and adapted to engage an adhesive material for affixing said frame-portion to said one electrode portion.

2. The transducer of claim 1 wherein another face is partially severed at selected points along the length thereof where said length of metal is bent to surround said one electrode portion.

3. The transducer of claim 1 including a thin flexible diaphram wherein said one frame portion has a portion thereof that is adapted to be fastened to a second such frame portion so that said flexible diaphram can be stretched between the first and second frame portions.

4. The transducer of claim 1 or 2 or 3 wherein said length of metal has an "L"-shaped cross section and said at least one face is on a leg of said "L".

5. The transducer of claim 1 or 2 or 3 wherein said channels are cut into said at least one face at an angle relative to the surface thereof so that said channels are deeper at one portion of said at least one face than at another.

6. The transducer of claim 3 including a gasket between said flexible diaphram and each of said frame portions.

7. The transducer of claim 3 wherein said flexible diaphram is affixed to at least one of said electrode portions in the stretched area between said first and second frame portions.

8. The transducer of claim 3 wherein said flexible diaphram is glued between the adjacent edges of said first and second frame portions.

9. A method of fabricating an electrostatic electroacoustic transducer of the type which includes electrode portions and frame portions, said method comprising the steps of:
   forming said frame portion from a length of metal;
   locating a plurality of channels in a face of said frame portion;
   bending said frame portion to surround one of said electrode portions;
   placing an adhesive-filler material between said frame portion and said electrode portion so that said adhesive-filler extends into said channels; and
   permitting said adhesive-filler material to cure to form a frame-electrode assembly.

10. The method of claim 9 incuding the step of:
   forming said channels at an angle relative to the surface of said face so that said channels are deeper at one portion of said face than at another.

11. The method of claim 9 including the step of:
   further finishing a second face of said frame member after said curing step to improve the flatness thereof.

12. The method of claim 9 wherein said bending step includes the formation of frame corners by bending said corners around dowell pins.

13. The method of claim 9 wherein said frame and electrode members are placed on a jig prior to application of said adhesive-filler material in a manner so that a surface of said electrode member adjacent said jig is on a plane that is higher than the surface of said frame member that is adjacent said jig.

14. The method of claim 13 including the step of:
   placing a bead of lubricant on said jig at portions thereof contiguous to said frame and electrode portions.

15. The method of claim 14 wherein said lubricant placement step includes placement of said lubricant by means of a channel-shaped member having one leg thereof shorter than another leg thereof by a distance corresponding to difference in elevation from said jig of the surfaces of said electrode and said frame that are adjacent said jig.

16. The method of claim 9, wherein said transducer includes a thin flexible diaphram and said method includes the step of locating one of said frame-electrode assemblies on either side of said thin flexible diaphram while said diaphram is held taut and fastening said frame-electrode assemblies to each other so that said diaphram remains taut therebetween.

17. The method of claim 16 including the step of locating a gasket between said thin flexible diaphram and each of said frame-electrode assemblies.

18. The method of claim 16 including the step of affixing said flexible diaphram to at least one of said electrode portions in the taut area surrounded by said frame-assemblies electrode.

19. The method of claim 16 including the step of gluing said flexible diaphram between said frame-electrode assemblies.

20. The method of claim 16 wherein surfaces of said flexible diaphram are coated with a conductive material and wherein said method includes the step of affixing a lead to said flexible diaphram by means of a piece of conductive shim stock.

21. The method of claim 9 including the step of partially severing said length of metal prior to said bending step where said length of metal is to be bent.

22. The method of claim 21 wherein said length of metal has an "L" shaped cross-section and the partial severance occurs on one of the legs thereof, said partial severance step being performed so that the ratio of the original thickness of the partially severed leg to the partially severed thickness thereof is about 3.

* * * * *